US010021963B2

(12) United States Patent
Johnson

(10) Patent No.: US 10,021,963 B2
(45) Date of Patent: Jul. 17, 2018

(54) DISPENSING TOOTHBRUSH ASSEMBLY

(71) Applicant: Steadman Johnson, Manvel, TX (US)

(72) Inventor: Steadman Johnson, Manvel, TX (US)

( * ) Notice: Subject to any disclaimer, the term of this patent is extended or adjusted under 35 U.S.C. 154(b) by 0 days.

(21) Appl. No.: 15/248,321

(22) Filed: Aug. 26, 2016

(65) Prior Publication Data

US 2018/0055209 A1 Mar. 1, 2018

(51) Int. Cl.
*A47L 13/22* (2006.01)
*A46B 11/00* (2006.01)

(52) U.S. Cl.
CPC ..... *A46B 11/001* (2013.01); *A46B 11/0086* (2013.01); *A46B 2200/1066* (2013.01)

(58) Field of Classification Search
CPC ..... B43K 8/18
USPC ..... 401/277
See application file for complete search history.

(56) References Cited

U.S. PATENT DOCUMENTS 2,652,949 A * 9/1953 Martin ..... A46B 11/0017 132/308
5,028,158 A * 7/1991 Fey ..... A46B 11/0041 401/183
5,123,765 A * 6/1992 O'Connell ..... A46B 5/0095 401/125
D375,407 S * 11/1996 Smith ..... A46B 5/0095 D4/108
5,846,010 A * 12/1998 Barbalich ..... A46B 5/02 401/183
5,913,632 A * 6/1999 Persad ..... A46B 11/0027 401/171
6,679,642 B1 * 1/2004 Dillingham ..... A46B 11/0041 401/134
6,817,803 B1 * 11/2004 Ong ..... A46B 11/0041 401/184
7,070,354 B1 * 7/2006 Gutierrez-Caro .. A46B 11/0027 401/171
7,128,492 B1 * 10/2006 Thames, Jr. ..... A46B 11/002 401/270
8,496,393 B2 * 7/2013 Martin ..... A46B 9/04 15/167.1
8,851,779 B2 * 10/2014 Jimenez ..... A46B 11/0024 401/171
9,339,103 B1 * 5/2016 Watters ..... A46B 11/0065
9,603,444 B2 * 3/2017 Boyd ..... A46B 11/001
2003/0215282 A1 * 11/2003 Edwards ..... A46B 11/0027 401/277
2009/0297253 A1 * 12/2009 Yuu ..... A46B 11/0055 401/277
2012/0103355 A1 * 5/2012 Bowie ..... A46B 11/0027 132/200
2013/0279964 A1 * 10/2013 Booker ..... A46B 11/001 401/140

* cited by examiner

*Primary Examiner* — Lori Baker

(57) ABSTRACT

A dispensing toothbrush assembly includes a toothbrush that may be manipulated. The toothbrush has a conduit therein. The conduit transports a fluid into the toothbrush thereby facilitating the toothbrush to clean teeth. A dispensing unit is provided and the dispensing unit contains toothpaste. The dispensing unit may be manipulated thereby facilitating the dispensing unit to urge the toothpaste outwardly from the toothbrush.

5 Claims, 3 Drawing Sheets

DISPENSING TOOTHBRUSH ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art including information disclosed under 37 CFR 1.97 and 1.98

The disclosure and prior art relates to toothbrush devices and more particularly pertains to a new toothbrush device for containing and dispensing toothpaste.

BRIEF SUMMARY OF THE INVENTION

An embodiment of the disclosure meets the needs presented above by generally comprising a toothbrush that may be manipulated. The toothbrush has a conduit therein. The conduit transports a fluid into the toothbrush thereby facilitating the toothbrush to clean teeth. A dispensing unit is provided and the dispensing unit contains toothpaste. The dispensing unit may be manipulated thereby facilitating the dispensing unit to urge the toothpaste outwardly from the toothbrush.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
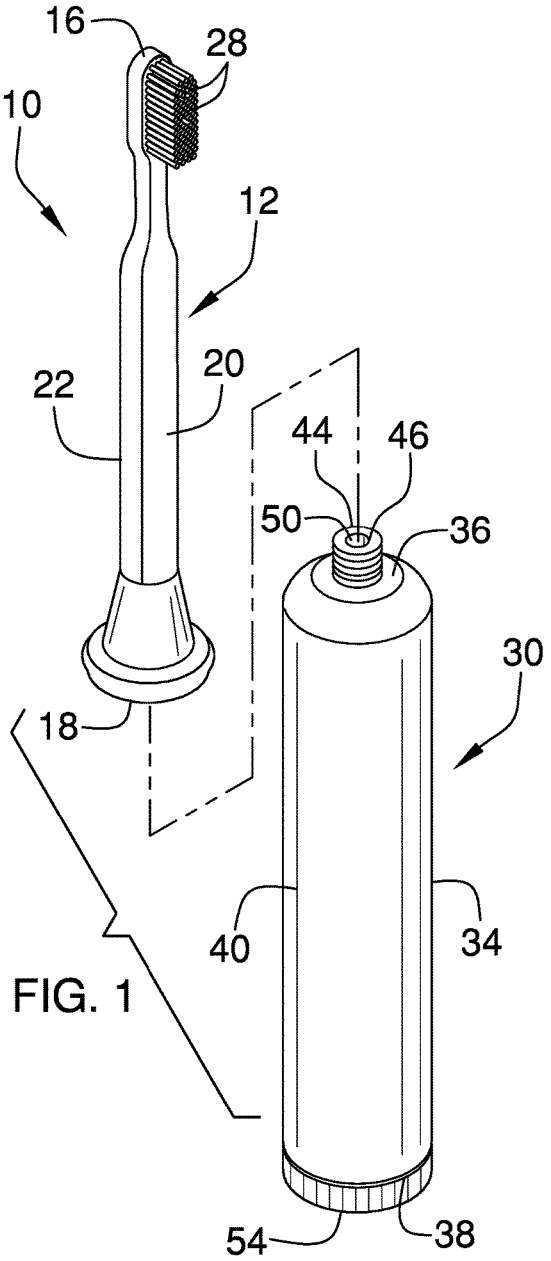
FIG. 1 is an exploded perspective view of a dispensing toothbrush assembly according to an embodiment of the disclosure.
Figure 2:
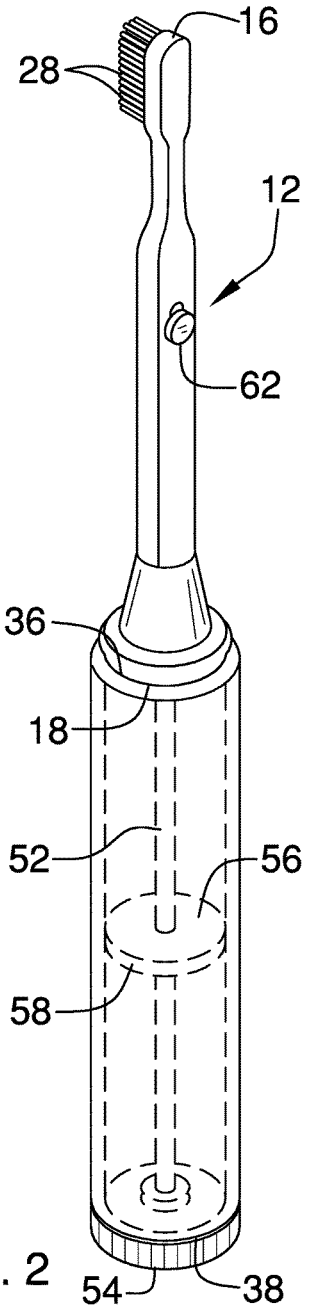
FIG. 2 is a perspective phantom view of an embodiment of the disclosure.
Figure 3:
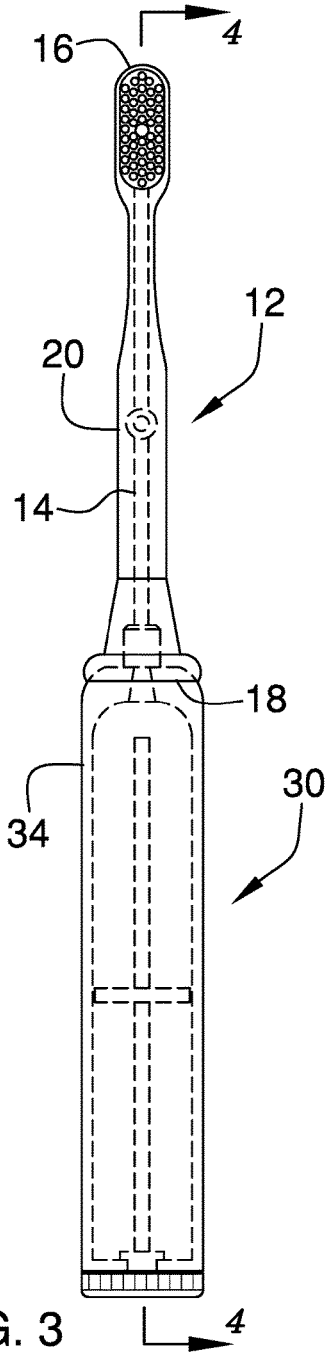
FIG. 3 is a front phantom view of an embodiment of the disclosure.
Figure 4:
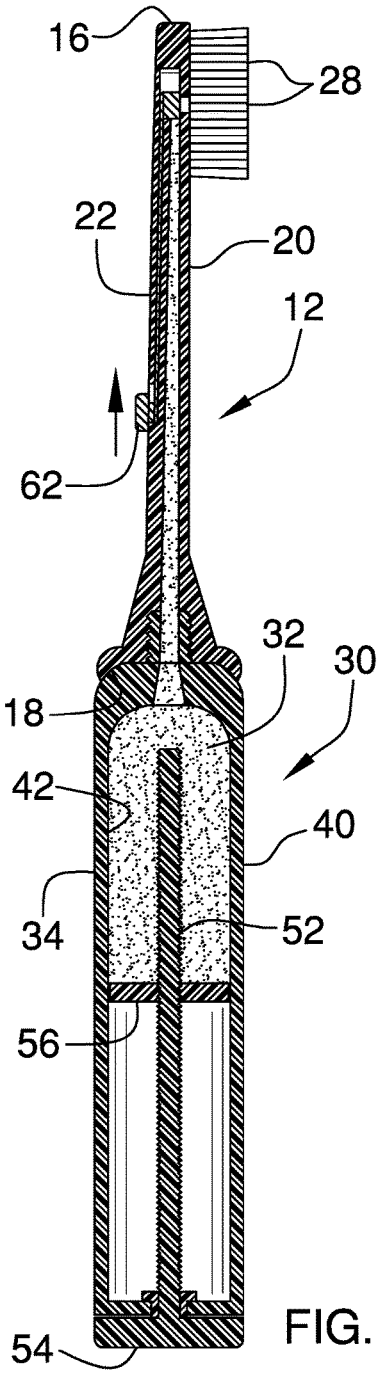
FIG. 4 is a cross sectional view taken along line 4-4 of FIG. 3 of an embodiment of the disclosure.
Figure 5:
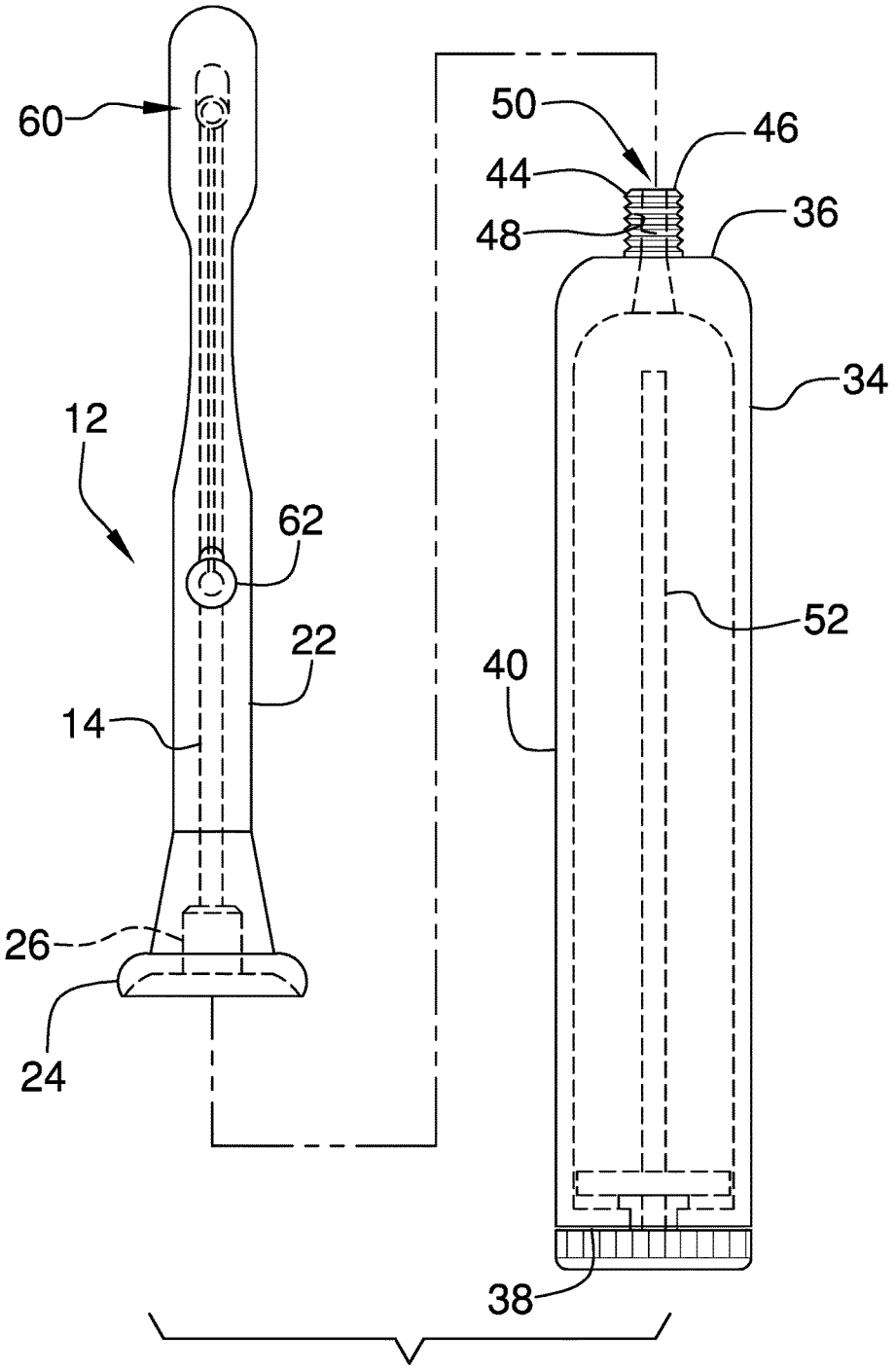
FIG. 5 is a rear exploded view of an embodiment of the disclosure.

With reference now to the drawings, and in particular to FIGS. 1 through 5 thereof, a new toothbrush device embodying the principles and concepts of an embodiment of the disclosure and generally designated by the reference numeral 10 will be described.

As best illustrated in FIGS. 1 through 5, the dispensing toothbrush assembly 10 generally comprises a toothbrush 12 that may be manipulated. The toothbrush 12 has a conduit 14 therein. The conduit 14 may transport a fluid into the toothbrush 12 thereby facilitating the toothbrush 12 to clean teeth. The toothbrush 12 has a first end 16, a second end 18, a front side 20 and a back side 22.

The first end 16 is open. The conduit 14 extends upwardly from the first end 16 toward and outwardly from the front side 20. The toothbrush 12 flares outwardly adjacent to the second end 18 to define a flange 24 on the second end 18. The flange 24 has an inner surface 26.

The toothbrush 12 has a plurality of bristles 28. Each of the bristles 28 is positioned on the front side 20. The bristles 28 are aligned with the second end 18. Moreover, the bristles 28 are aligned with the conduit 14. Each of the bristles 28 frictionally engages the teeth.

A dispensing unit 30 is provided. The dispensing unit 30 contains toothpaste 32. The toothpaste 32 may be fluid toothpaste 32 or the like. The dispensing unit 30 may be manipulated. Thus, the dispensing unit 30 urges the toothpaste 32 outwardly from the toothbrush 12.

The dispensing unit 30 comprises a cylinder 34 that may be gripped. The cylinder 34 has a top end 36, a bottom end 38 and an outer wall 40 extending therebetween. The cylinder 34 is substantially hollow to contain the toothpaste 32. The outer wall 40 has an inside surface 42.

A nozzle 44 is coupled to the top end 36 of the cylinder 34. The nozzle 44 has a distal end 46 with respect to the top end 36 and an outer surface 48. The distal end 46 has an opening 50 extending into an interior of the cylinder 34. The outer surface 48 is threaded. The inner surface 26 of the flange 24 threadably engages the outer surface 48 of the nozzle 44. Thus, the toothbrush 12 is removably coupled to the cylinder 34. Moreover, the conduit 14 is in fluid communication with the nozzle 44.

A shaft 52 is positioned within the cylinder 34 and the shaft 52 is threaded. A knob 54 is rotatably coupled to the bottom end 38 of the cylinder 34 and the knob 54 may be manipulated. The shaft 52 is coupled to and extends upwardly from the knob 54. Thus, the knob 54 rotates the shaft 52 when the knob 54 is manipulated. A bushing may be coupled between the shaft 52 and the knob 54. The bushing may engage the bottom end 38 of the cylinder 34.

A disk 56 is positioned within the cylinder 34. The disk 56 has an outer edge 58. The outer edge 58 engages the inner surface 26 of the cylinder 34. The shaft 52 extends through the disk 56 and the disk 56 threadably engages the shaft 52. The disk 56 is urged upwardly along the shaft 52 when the knob 54 is rotated. Thus, the disk 56 urges the toothpaste 32 outwardly through the nozzle 44 thereby facilitating the toothpaste 32 to be dispensed onto the bristles 28.

A valve 60 is movably coupled to the toothbrush 12. The valve 60 is in fluid communication with the conduit 14. Thus, the valve 60 selectively restricts and allows the toothpaste 32 to flow through the conduit 14. The valve 60 includes a button 62 that is positioned on the back side 22 of the toothbrush 12. Thus, the button 62 may be manipulated. The button 62 urges the valve 60 between an open position and a closed position. The valve 60 may be a fluid valve 60 or the like.

In use, the cylinder 34 is manufactured containing the toothpaste 32. The toothbrush 12 is threadably coupled to the nozzle 44. The button 62 on the valve 60 is manipulated to urge the valve 60 into the open position. The knob 54 is rotated to urge the toothpaste 32 outwardly from the conduit 14 to be deposited on the bristles 28. The cylinder 34 is discarded when the cylinder 34 is emptied. A replacement cylinder 34 is purchased and the toothbrush 12 is threadably coupled to the replacement cylinder 34.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A dispensing toothbrush assembly being configured to selectively dispense a toothpaste, said assembly comprising:

a toothbrush being configured to be manipulated, said toothbrush having a conduit therein wherein said conduit is configured to transport a fluid into said toothbrush thereby facilitating said toothbrush to clean teeth, said toothbrush having a first end, a second end, a front side and a back side, said first end being open, said conduit extending upwardly from said first end and outwardly from said front side, said toothbrush flaring outwardly adjacent to said second end to define a flange on said second end, said flange having an inner surface, said toothbrush having a plurality of bristles, each of said bristles being positioned on said front side, said bristles being aligned with said second end, said bristles being aligned with said conduit; and a dispensing unit being configured to contain toothpaste, said dispensing unit being configured to be manipulated thereby facilitating said dispensing unit to urge the toothpaste outwardly from said toothbrush, said dispensing unit comprises a cylinder being configured to be gripped, said cylinder having a top end, a bottom end and an outer wall extending therebetween, said cylinder being substantially hollow wherein said cylinder is configured to contain the toothpaste, said outer wall having an inside surface;

a shaft being positioned within said cylinder, said shaft being threaded; and a knob being rotatably coupled to said bottom end of said cylinder wherein said knob is configured to be manipulated, said shaft having a bottom end being coupled to said knob, said shaft extending upwardly from said knob such that said knob rotates said shaft, said shaft having a free end positioned within said cylinder opposite said bottom end, said conduit being positioned in linear alignment with said shaft.

2. The assembly according to claim 1, further comprising:

a flange having an inner surface; and a nozzle being coupled to said top end of said cylinder, said nozzle having a distal end with respect to said top end and an outer surface, said distal end having an opening extending into an interior of said cylinder, said outer surface being threaded, said inner surface of said flange threadably engaging said outer surface of said nozzle such that said toothbrush is removably coupled to said cylinder, said conduit being in fluid communication with said nozzle.

3. The assembly according to claim 1, further comprising:

a nozzle;

a disk being positioned within said cylinder, said disk having an outer edge, said outer edge engaging said inner surface of said cylinder, said shaft extending through said disk having said disk threadably engaging said shaft, said disk being urged upwardly along said shaft when said knob is rotated wherein said disk is configured to urge the toothpaste outwardly through said nozzle thereby facilitating the toothpaste to be dispensed onto said bristles.

4. The assembly according to claim 1, further comprising a valve being movably coupled to said toothbrush, said valve being in fluid communication with said conduit wherein said valve is configured to selectively restrict and allow the toothpaste to flow through said conduit, said valve including a button being positioned on said back side of said toothbrush wherein said button is configured to be manipulated, said button urging said valve between an open position and a closed position.

5. A dispensing toothbrush assembly being configured to selectively dispense a toothpaste, said assembly comprising:

a toothbrush being configured to be manipulated, said toothbrush having a conduit therein wherein said conduit is configured to transport a fluid into said toothbrush thereby facilitating said toothbrush to clean teeth, said toothbrush having a first end, a second end, a front side and a back side, said first end being open, said conduit extending upwardly from said first end toward and outwardly from said front side, said toothbrush flaring outwardly adjacent to said second end to define a flange on said second end, said flange having an inner surface, said toothbrush having a plurality of bristles, each of said bristles being positioned on said front side, said bristles being aligned with said second end, said bristles being aligned with said conduit; and a dispensing unit being configured to contain a toothpaste, said dispensing unit being configured to be manipulated thereby facilitating said dispensing unit to urge the toothpaste outwardly from said toothbrush, said dispensing unit comprising:

a cylinder being configured to be gripped, said cylinder having a top end, a bottom end and an outer wall extending therebetween, said cylinder being substantially hollow wherein said cylinder is configured to contain the toothpaste, said outer wall having an inside surface, a nozzle being coupled to said top end of said cylinder, said nozzle having a distal end with respect to said top end and an outer surface, said distal end having an opening extending into an interior of said cylinder, said outer surface being threaded, said inner surface of said flange threadably engaging said outer surface of said nozzle such that said toothbrush is removably coupled to said cylinder, said conduit being in fluid communication with said nozzle, a shaft being positioned within said cylinder, said shaft being threaded, a knob being rotatably coupled to said bottom end of said cylinder wherein said knob is configured to be manipulated, said shaft having a bottom end being coupled to said knob, said shaft extending upwardly from said knob such that said knob rotates said shaft, said shaft having a free end positioned within said cylinder opposite said bottom end, said conduit being positioned in linear alignment with said shaft, and a disk being positioned within said cylinder, said disk having an outer edge, said outer edge engaging said inner surface of said cylinder, said shaft extending through said disk having said disk threadably engaging said shaft, said disk being urged upwardly along said shaft when said knob is rotated wherein said disk is configured to urge the toothpaste outwardly through said nozzle thereby facilitating the toothpaste to be dispensed onto said bristles, and a valve being movably coupled to said toothbrush, said valve being in fluid communication with said conduit wherein said valve is configured to selectively restrict and allow the toothpaste to flow through said conduit, said valve including a button being positioned on said back side of said toothbrush wherein said button is configured to be manipulated, said button urging said valve between an open position and a closed position.

* * * * *